US006612902B1

(12) United States Patent
Boyd et al.

(10) Patent No.: US 6,612,902 B1
(45) Date of Patent: Sep. 2, 2003

(54) METHOD AND APPARATUS FOR END POINT TRIGGERING WITH INTEGRATED STEERING

(75) Inventors: John M. Boyd, Atascadero, CA (US); Herbert E. Litvak, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 121 days.

(21) Appl. No.: 09/823,198

(22) Filed: Mar. 29, 2001

(51) Int. Cl.[7] ..... B24B 49/00; B24B 51/00; B24B 1/00

(52) U.S. Cl. ..... 451/6; 451/9; 451/10; 451/41

(58) Field of Search ..... 216/88, 89; 438/692, 438/693; 451/5, 6, 8, 9, 10, 11, 36, 41, 59, 63, 285–290

(56) References Cited

U.S. PATENT DOCUMENTS

| | | | | |
|---|---|---|---|---|
| 6,213,845 | B1 * | 4/2001 | Elledge | 451/6 |
| 6,247,998 | B1 * | 6/2001 | Wiswesser et al. | 451/41 |
| 6,261,155 | B1 * | 7/2001 | Jairath et al. | 451/10 |
| 6,447,369 | B1 * | 9/2002 | Moore | 451/10 |

FOREIGN PATENT DOCUMENTS

| | | |
|---|---|---|
| EP | 0824995 | 2/1998 |
| EP | 0914908 | 5/1999 |
| WO | WO 01/15863 | 3/2001 |

* cited by examiner

*Primary Examiner*—Timothy V. Eley
(74) *Attorney, Agent, or Firm*—Martine & Penilla, LLP

(57) ABSTRACT

An invention is disclosed for end point triggering in a chemical mechanical polishing process. A sensor array is positioned beneath a polishing belt having an end point window. The polishing belt is then rotated during the CMP process, and a transverse position of the end point window is determined based on a portion of the sensor array covered by a particular portion of the polishing belt. The particular portion of the polishing belt can be the end point window, a trigger slot, or a portion of the polishing belt covered by a reflective material. The sensor array can optionally be a charged coupled device (CCD), or a linear array of sensors. In operation, the positional information is determined based on which sensors are covered by the particular portion of the polishing belt. The positional information is then communicated to a belt steering system, which corrects the transverse position of the end point window based on which sensors are covered by the particular portion of the polishing belt.

25 Claims, 11 Drawing Sheets

METHOD AND APPARATUS FOR END POINT TRIGGERING WITH INTEGRATED STEERING

BACKGROUND OF THE INVENTION

1. Field of the Invention

This invention relates generally to chemical mechanical polishing apparatuses, and more particularly to methods and apparatuses for end point triggering with integrated steering in a chemical mechanical polishing system.

2. Description of the Related Art

In the prior art, chemical mechanical polishing (CMP) systems typically implement belt, orbital, or brush stations in which belts, pads, or brushes are used to scrub, buff, and polish a wafer. To facilitate and enhance the CMP operation, slurry is used. Slurry generally is introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface. In addition, end point detection mechanisms are used to determine when to end the CMP process. The end point detection mechanism senses the wafer layers through an end point window when triggered by an end point trigger mechanism.

FIG. 1A is diagram showing a prior art CMP system 100*a*. The CMP system 100*a* includes a polishing belt 101 and rollers 102, which physically rotate the belt and provide belt steering. During the CMP process, a wafer is positioned at wafer position 106, generally via a carrier having a retainer ring that holds the wafer in position during polishing. Beneath the wafer position 106 is a platen 104 for wafer support during polishing. To facilitate end point detection, an end point window 108 is disposed within the polishing belt 101.

Further disposed within the polishing belt 101 is a trigger slot 110, which is used in conjunction with an end point trigger mechanism. In operation, the end point trigger mechanism detects the trigger slot 110 whenever the trigger slot 110 passes over the end point trigger mechanism. Then, as will be described in greater detail with respect to FIG. 2, the end point trigger mechanism provides a signal to a CMP controller, which controls end point detection. In this manner, the prior art CMP system 100*a* can synchronize end point detection sensing with the end point window 108 in the polishing belt 101. To help maintain the centralized position of the end point window 108 with respect to the wafer position 106 and platen 104, limit sensors are used.

FIG. 1B is a diagram showing a top view of a prior art CMP system 100*b*. The prior art CMP system 100*b* includes rollers 102, and a polishing belt 101 having an end point window 108 and a trigger slot 110 to facilitate end point detection control. The end point detection mechanism performs best when the end point window 108 is centered above the end point detection sensor. Thus, limit sensors 112 are used to detect the lateral position of the polishing belt 101 during operation. When the polishing belt 101 moves off center, the limit sensors detect the position of the polishing belt 101 and provide the positional information to a belt steering mechanism. The belt steering mechanism then adjusts the lateral position of the polishing belt 101 using the rollers 102.

FIG. 2 is a diagram showing a conventional end point trigger mechanism 200. The end point trigger mechanism 200 includes a polishing belt 101 having an end point window 108 and a trigger slot 110. Further included are a trigger sensor 206, which detects light from a light source 204, and a CMP controller, which receives information from the trigger sensor 206 and an end point detection sensor 208. The end point detection sensor 208 senses the current layer status of the wafer 202 in a CMP process.

Generally, the trigger sensor 206 is an optical sensor that detects the presence of the trigger slot 110 by the intensity of the light detected from the light source 204. Specifically, the polishing belt 101 blocks light from the light source 204, except when the trigger slot is 110 present above the trigger sensor 206. Thus, when the trigger sensor 206 detects a light intensity above a predefined threshold, a message is sent to the CMP controller 212 that the trigger slot 110 is presently positioned above the trigger sensor 206. Since the trigger slot 110 is positioned a know distance from the end point window 108 and the belt speed is known, the appropriate delay can be calculated that will trigger end point data acquisition when the end point window 108 is aligned with the platen window 210 of the platen 104.

As previously mentioned, belt steering is provided using limit sensors. End point signal strength in part depends upon both the alignment of the end point window 108 above the platen window 210 in the direction transverse to belt travel and the alignment in the belt travel direction. However, conventional CMP systems 100*a* and 100*b* use two separate, unrelated methods to position the end point window 108 and synchronize the end point data acquisition. Specifically, the alignment in the direction transverse to belt travel is determined using the limit sensors, while the alignment in the belt travel direction is determined by the synchronization of the end point window 108 with the platen window 210 using the trigger sensor 206.

Using two independent methods to align the end point window 108 with the platen window 210 causes problems in both the reliability of the end point detection system and the system set up time. Thus, there is a need for reliable systems and methods for improved end point trigger mechanisms that improve end point detection reliability and reduce system setup time.

SUMMARY OF THE INVENTION

Broadly speaking, the present invention fills these needs by providing a sensor array that determines the longitudinal and transverse position of the end point window, as well as the belt speed of the polishing belt. In one embodiment, a method for end point triggering in a chemical mechanical polishing process is disclosed. A sensor array is positioned beneath a polishing belt having an end point window. The polishing belt is then rotated during the CMP process, and a transverse position of the end point window is determined based on a portion of the sensor array covered by a particular portion of the polishing belt. The particular portion of the polishing belt can be the end point window, a trigger slot, or a portion of the polishing belt covered by a reflective material. Further, the sensor array can optionally be a charged coupled device (CCD), or a linear array of sensors. In operation, the positional information is determined based on which sensors are covered by the particular portion of the polishing belt. The positional information is then communicated to a belt steering system, which corrects the transverse position of the end point window based on which sensors are covered by the particular portion of the polishing belt. The time to begin end point detection is based on a longitudinal position of the end point window, and the speed of the belt can be determined based on intensities sensed by the sensor array.

In another embodiment, an apparatus for end point triggering in a chemical mechanical polishing process is disclosed. The apparatus includes a sensor array that is disposed beneath a polishing belt, which includes an end point window. The apparatus determines a position of the end point window based on a portion of the sensor array covered by a particular portion of the polishing belt. As above, the particular portion of the polishing belt can be the end point window, a trigger slot, or a portion of the polishing belt covered by a reflective material, and the sensor array can optionally be a charged coupled device (CCD), or a linear array of sensors.

A system for end point triggering in a chemical mechanical polishing process is disclosed in a further embodiment of the present invention. The system includes a polishing belt having an end point window, and a sensor array disposed beneath a polishing belt. The sensory array can determine a position of the end point window based on a portion of the sensor array covered by a particular portion of the polishing belt, which can be can be the end point window, a trigger slot, or a portion of the polishing belt covered by a reflective material. The system further includes a belt steering system that corrects the belt position based on the position of the end point window.

Advantageously, the embodiments of the present invention logically correlate signals from multiple detector elements in an array so as to provide corroborative synchronization and steering information from multiple sensing points. This ability greatly enhances the robustness and reliability of belt steering and end point detection during the CMP process. In addition, by combining two separate functions into a single sensing apparatus, the embodiments of the present invention greatly simplify system set up and improve reliability.

Moreover, by using multiple sensors in a wet environment, the embodiments of the present invention reduce the number of errors often encountered in prior art systems, which use single sensors designed for a dry environment. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for an end point trigger mechanism having integrated belt steering in a CMP environment. Using a sensor array, the present invention integrates into a single sensing apparatus both end point detection triggering functions and belt steering functions. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
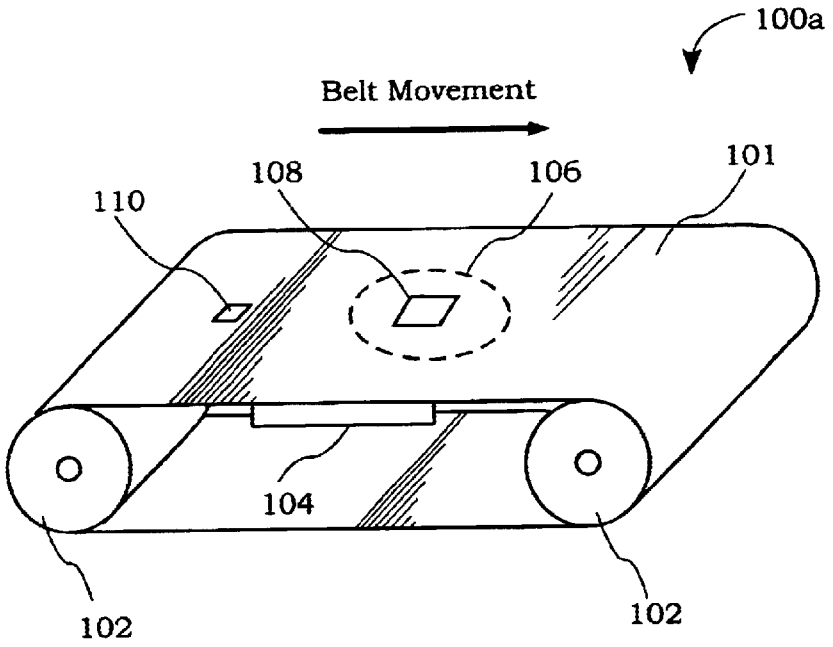
FIG. 1A (Prior Art)
FIG. 1A is diagram showing a prior art CMP system.
Figure 1B:
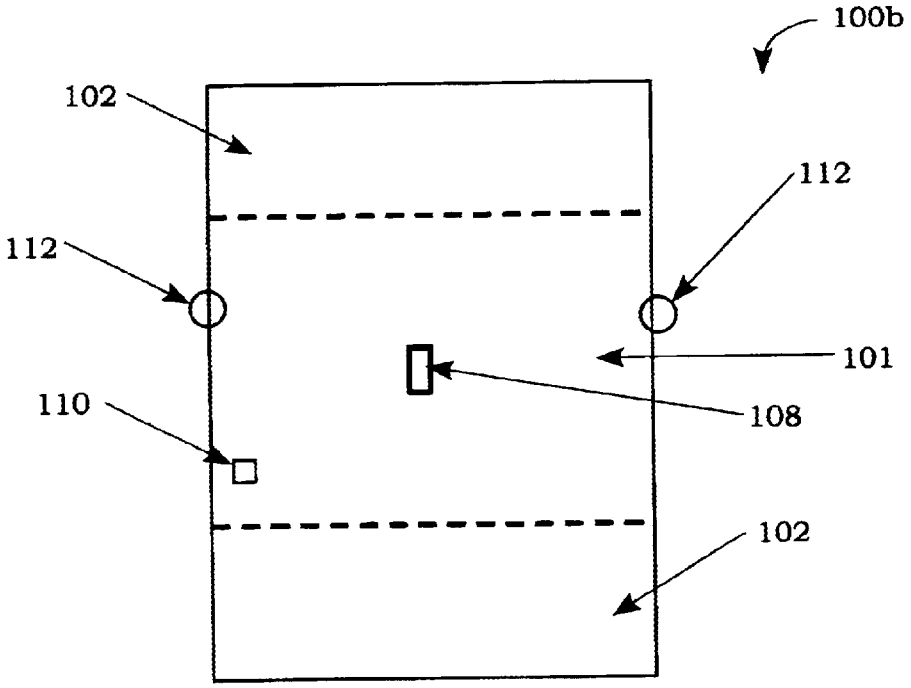
FIG. 1B (Prior Art)
FIG. 1B is a diagram showing a top view of a prior art CMP system.
Figure 2:
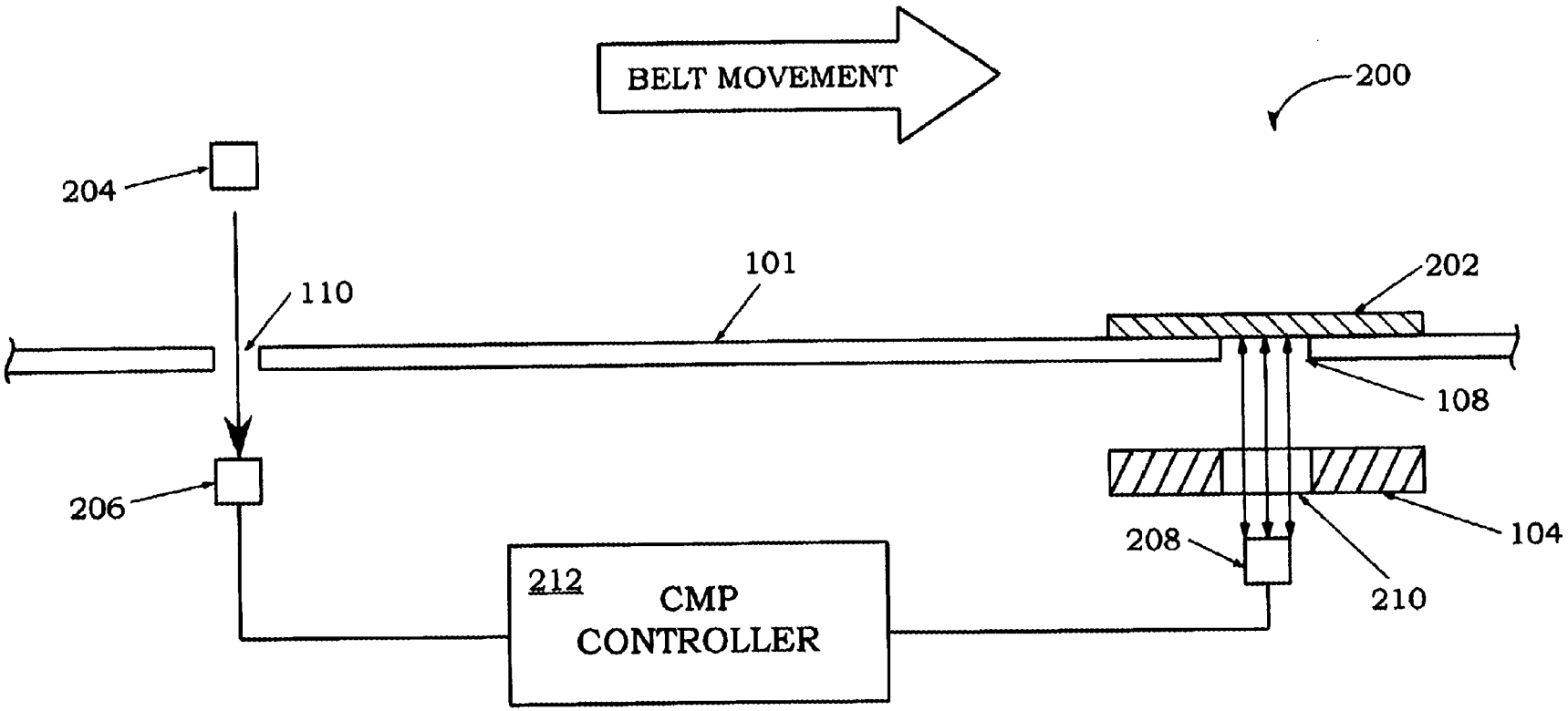
FIG. 2 (Prior Art)
FIG. 2 is a diagram showing a conventional end point trigger mechanism.
Figure 3:
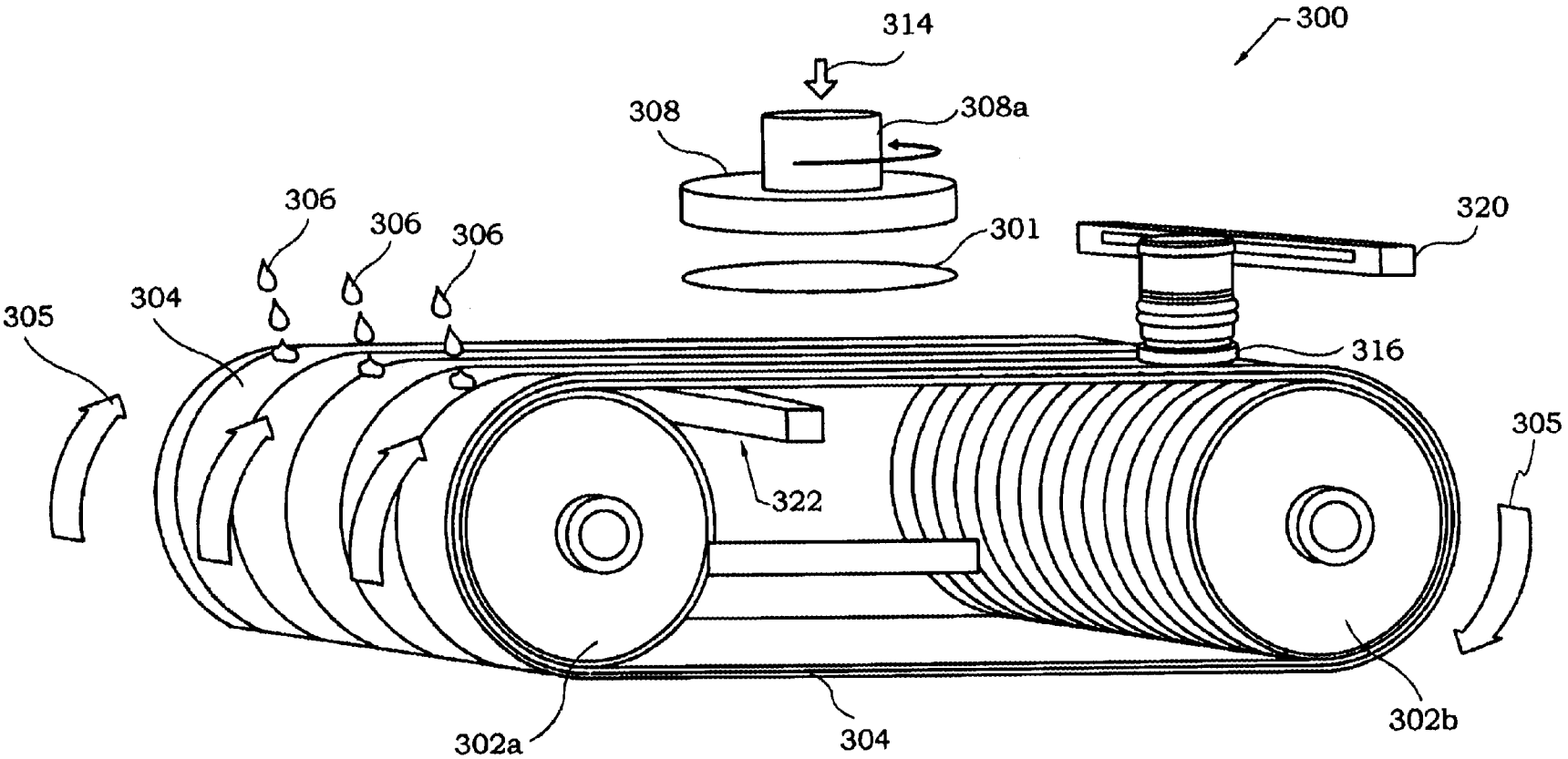
FIG. 3 shows a CMP system including an end-point trigger mechanism, in accordance with one embodiment of the present invention.

FIGS. 1A, 1B, and 2 have been described in terms of the prior art. FIG. 3 shows a CMP system 300 including an end-point trigger mechanism, in accordance with one embodiment of the present invention. The end-point trigger mechanism is designed to include a sensor array 322 positioned below the polishing belt 304. As is well known, the carrier 308 is designed to hold a wafer 301 and apply the wafer 301 to the surface of a polishing belt 304. The polishing belt 304 is designed to move in a belt motion direction 305 around rollers 302*a* and 302*b*.

Generally, the polishing belt 304 is provided with slurry 306 that assists in the chemical mechanical polishing of the wafer 301. In this embodiment, the CMP system 300 also includes a conditioning head 316 that is connected to a track 320. The conditioning head is designed to scrub the surface of the polishing belt 304 either in an in-situ manner or an ex-situ manner. As is well known, the conditioning of the polishing belt 304 is designed to re-condition the surface of the polishing belt 304 to improve the performance of the polishing operations. As will be described in greater detail subsequently, the sensor array 322 is used to trigger end point data acquisition and to provide belt position information during the CMP process.

Figure 4:
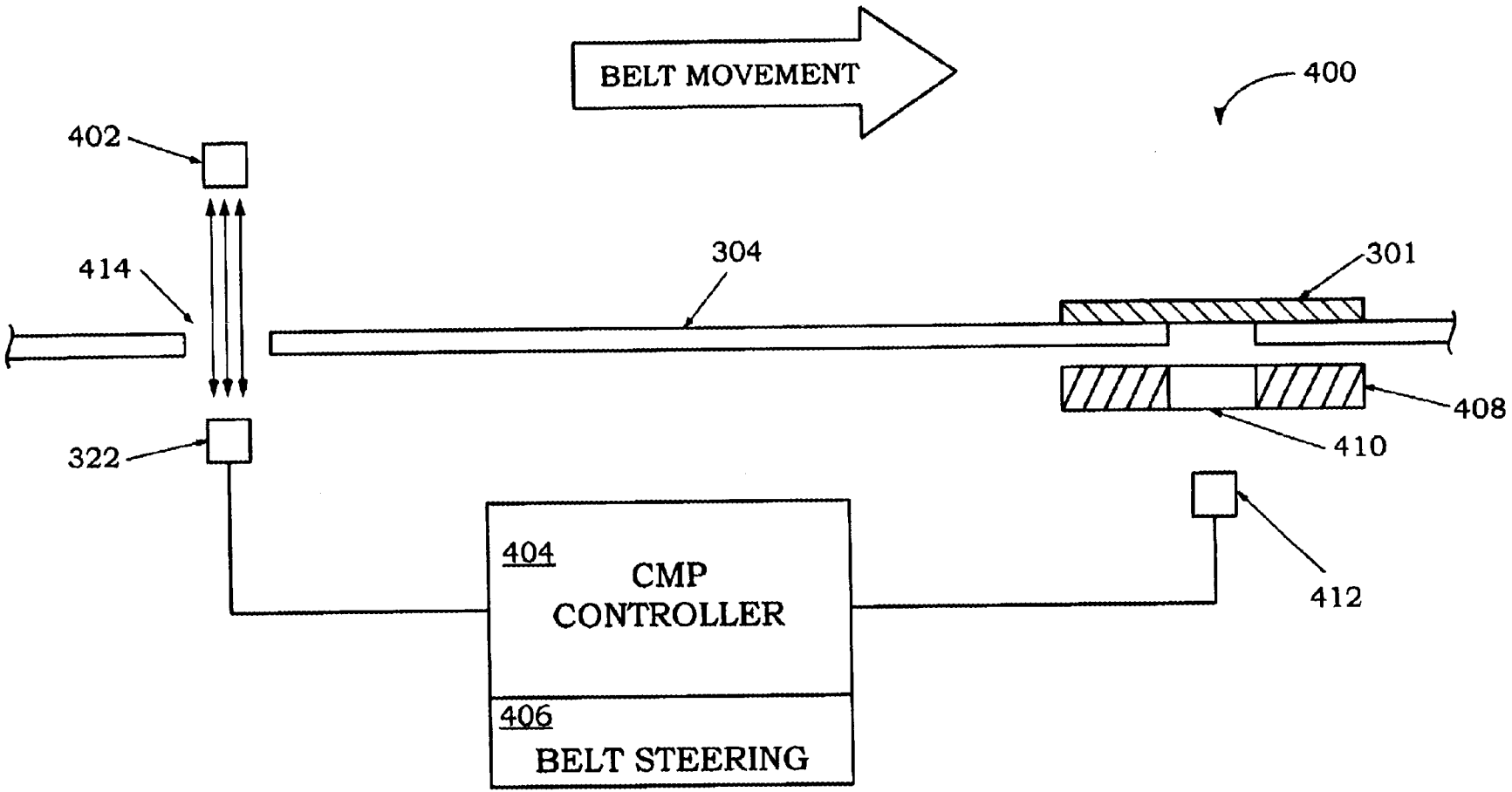
FIG. 4 is a diagram showing an end point trigger system, in accordance with an embodiment of the present invention.

FIG. 4 is a diagram showing an end point trigger system 400, in accordance with an embodiment of the present invention. The end point trigger system 400 includes a polishing belt 304 having an end point window 414, a light source 402, a sensor array 322, a platen 408 having a platen window 410, an end point detection sensor 412, and a CMP controller 404 in communication with a belt steering system 406.

The sensor array 322 shown in FIG. 4 comprises a plurality of sensors capable of detecting light from the light source 402, however, it should be noted that other types of sensor arrays can be used in the embodiments of the present invention, as will be discussed in greater detail subsequently. As the polishing belt 304 rotates during the CMP process, the intensity of the light sensed by the sensor array 322 rises sharply when the end point window 414 is directly above the sensor array. Thus, when the sensor array 322 senses a sharp rise in light intensity, the end point window 414 is above the sensor array 322 and the intensity information is provided to the CMP controller 404.

The CMP controller 404 then uses the polishing belt speed and the distance between the sensor array 322 and the platen window 410 to calculate the delay until the end point window 414 will be positioned over the end point detection sensor 412, and end point data acquisition is performed using the end point detection sensor 412. In this manner, the sensor array 322 functions as an end point trigger mechanism for end point data acquisition.

In addition, the sensor array 322 provides transverse positional information for the end point window 414 relative to the sensor array 322. This transverse positional information is provided to the belt steering system 406 for positional correction, as will be described in greater detail below.

Figure 5:
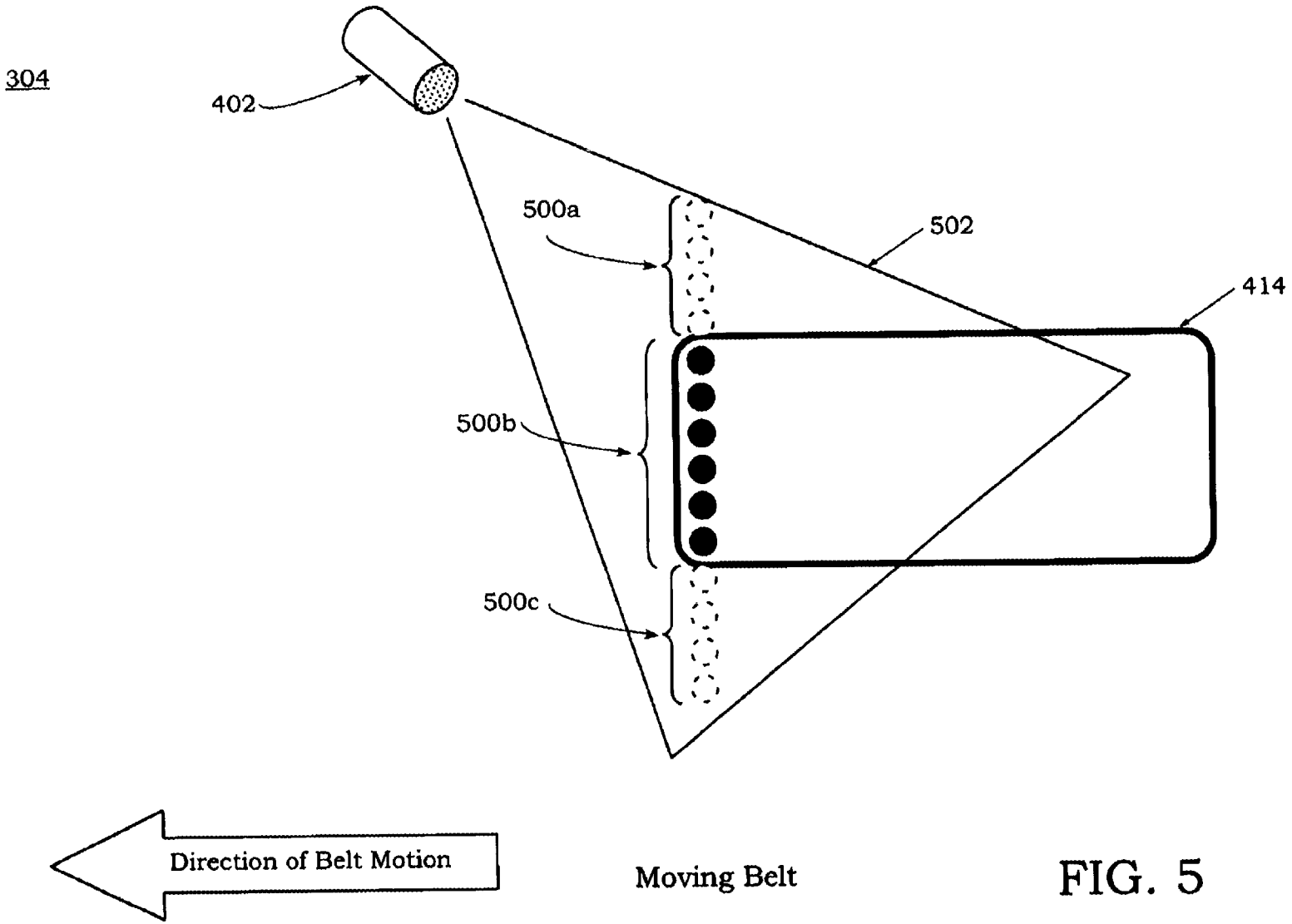
FIG. 5 is an illustration showing transverse positional detection components of an end point trigger mechanism in accordance with an embodiment of the present invention.

FIG. 5 is an illustration showing transverse positional detection components of an end point trigger mechanism in accordance with an embodiment of the present invention. FIG. 5 shows the end point window 414 in the polishing belt 304 positioned above the sensor array having sensors 500*a*, 500*b*, and 500*c*. Further shown is the light source 402, which generates an illumination cone 502. By determining which sensors are illuminated by the illumination cone 502 and which sensors are not illuminated, the transverse position of the end point window 414 can be determined.

FIG. 5 shows the end point window 414 centered above the sensor array, and thus aligned with the platen window. In particular, sensors 500*a* are non-illuminated, as are sensors 500*c*, because they are blocked from the illumination cone 502 by the polishing belt 304. However, sensors 500*b* are illuminated by the illumination cone 502 through the end point window 414. Since, in the embodiment of FIG. 5, the sensor array is aligned with the platen window, the situation shown in FIG. 5 illustrates the end point window being correctly aligned with the platen window. In this case, if any of the 500*a* sensors become illuminated the polishing belt would need to be moved in a direction toward sensors 500*c*. Similarly, if any of the 500*c* sensors become illuminated the polishing belt would need to be moved in a direction toward sensors 500*a*. In this manner, the transverse position of the end point window can be determined and corrected using the plurality of sensors 500*a*, 500*b*, and 500*c* of the sensor array.

In addition, the longitudinal position and speed of the polishing belt 304 can be determined using the leading and trailing edges of the end point window 414. Specifically, the leading edge of the end point window 414 can be used to determine the longitudinal position of the polishing belt 304. To this end, when the sensors 500*b* are illuminated by the illumination cone 502 of the light source 402, the end point window 414 is positioned above the sensor array. The speed of the polishing belt 304 can be determined by the time interval between the leading edge of the end point window 414 passing over the sensors and the trailing edge of the end point window 414 passing over the sensors. Thus, the duration of illumination of the sensors of the sensor array can be used to calculate the speed of the polishing belt 304 since the distance between the leading edge and the trailing edge of the end point window 414 is known.

Although the sensor array is shown beneath the end point window 414 of the polishing belt 304, it should be noted that a trigger slot can also be used for the end point trigger mechanism. In this case the sensor array would be aligned with the trigger slot and the belt positional information would be determined based on light detected though the trigger slot.

Figure 6:
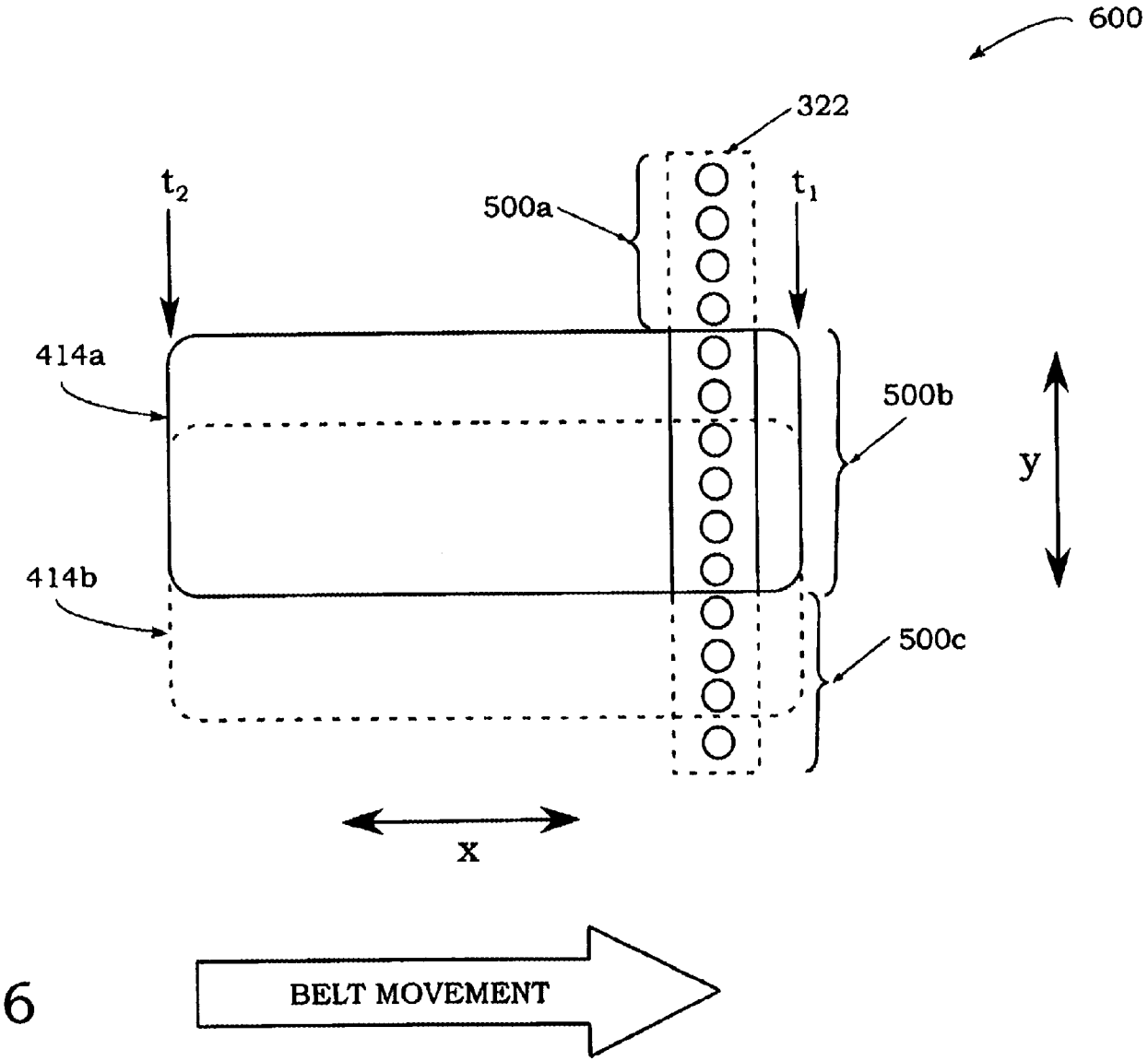
FIG. 6 is a diagram showing an end point trigger system in accordance with an embodiment of the present invention.

FIG. 6 is a diagram showing an end point trigger system 600 in accordance with an embodiment of the present invention. The end point trigger system 600 includes a sensor array 322 having a plurality of sensors 500*a*, 500*b*, and 500*c*. Further shown in FIG. 6 is an end point window 414. Two positions of the end point window are illustrated in FIG. 6, a first transverse position 414*a* and a second transverse position 414*b*.

The first transverse position of the end point window at 414*a*, shows the end point window 414*a* aligned correctly with the platen window for good end point data acquisition. In this position, sensors 500*a* and 500*c* of the sensor array 322 are covered by the polishing belt and thus are not illuminated by the light source. In this case, the sensor array 322 is configured such that when sensors 500*b* are illuminated and sensors 500*a* and 500*c* are non-illuminated the end point window 414*a* is aligned with the platen window for good end point data acquisition. Thus, at position 414*a* the end point window is properly aligned with the platen window.

The second transverse position of the end point window at 414*b* shows the end point window 414*b* unaligned with the platen window. Here the end point window 414*b* is positioned over a portion of sensors 500*c*, and hence a portion of the 500*c* sensors are illuminated by the light source when the end point window passes over the sensor array 322. The actual number and intensity detected by sensors 500*c* is used to determine the amount of correction needed by the belt steering system to realign the end point window 414*b* correctly with he platen window. In this manner, the transverse position of the end point window can be determined and corrected when necessary.

Figure 7:
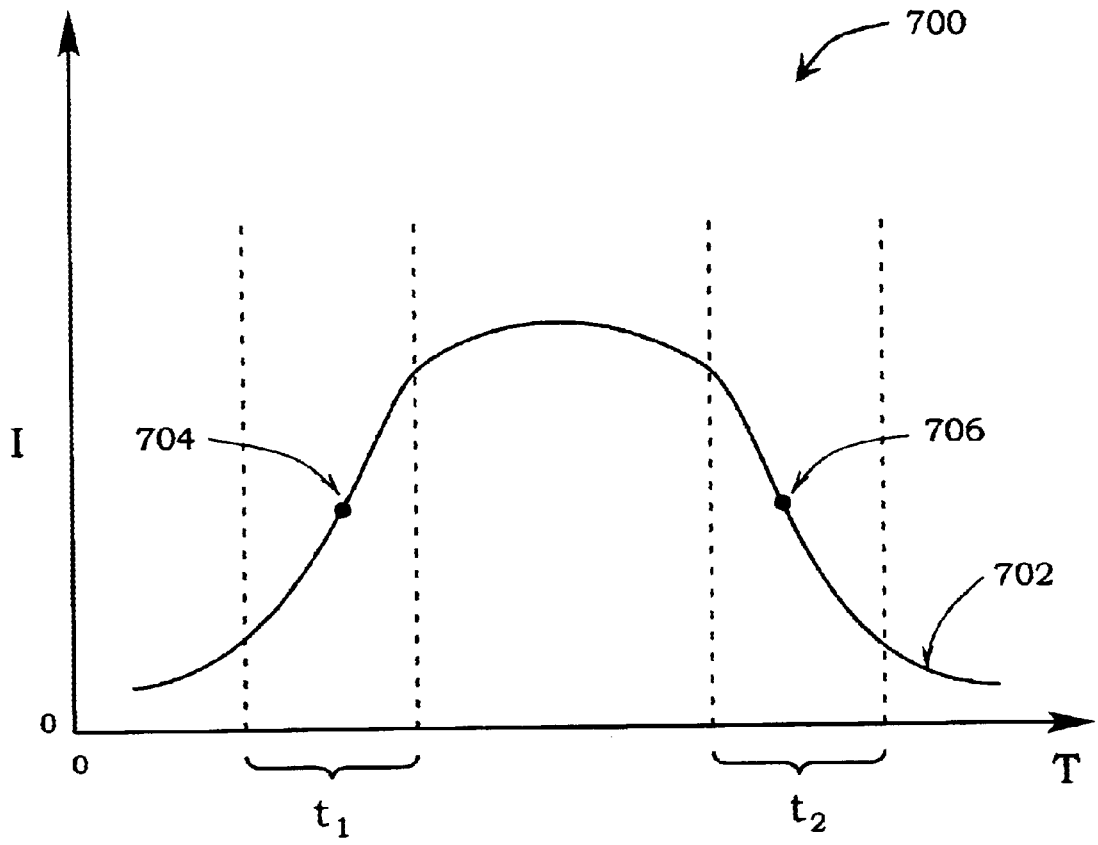
FIG. 7 is an intensity graph of light intensities detected by a sensor array of the embodiments of the present invention.

As previously mentioned, the embodiments of the present invention can also determine the speed of the polishing belt by analyzing the light intensities detected by the sensors of the sensor array 322. FIG. 7 is an intensity graph 700 of light intensities detected by a sensor array of the embodiments of the present invention. As shown in the intensity graph 700, the intensity 702 of the light detected by the sensors of the sensor array varies with the position of the end point window. Specifically, when the end point window is not positioned over the sensor array, the light intensity detected by the sensor array is low, as shown by the edges of the graph of the light intensities 702.

However, when the end point window is positioned over the sensor array the light intensities 702 detected by the sensor array changes dramatically. Specifically, as the leading edge of the end point window begins to pass over the sensor array the light intensity rises sharply. Then as the end point window is fully over the sensor array the light intensity reaches a plateau. Finally, as the trailing edge of the end point window travels over the sensor array the light intensities drop sharply. By analyzing the time between the low and plateau of the graph of the intensity 702, a point 704 can be calculated that estimates the time when the leading edge of the end point window has passed the sensor array. Similarly, by analyzing the time between the plateau and the low portion of the graph of the intensity 702, a point 706 can be calculated that estimates the time when the trailing edge of the end point window has passed the sensor array. Then, the belt speed can be calculated using the time differential between point 704 and point 706 since the physical distance between the leading edge and the trailing edge of the end point window is known.

Figure 8:
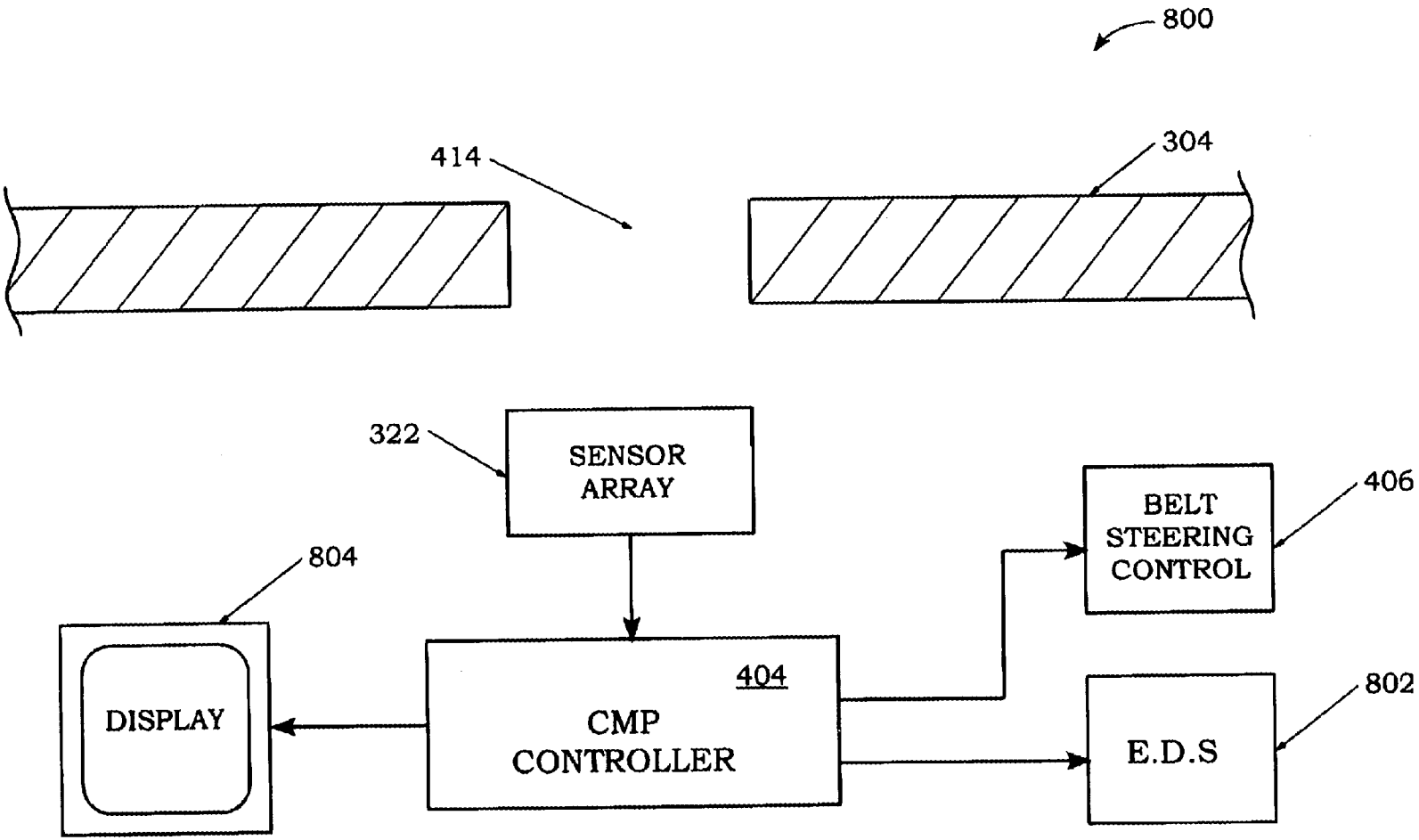
FIG. 8 is a diagram showing an end point trigger system in accordance with an embodiment of the present invention.

FIG. 8 is a diagram showing an end point trigger system 800 in accordance with an embodiment of the present invention. The end point trigger system 800 includes a sensor array 322 positioned beneath a polishing belt 304 having an end point window 414. The sensor array 322 is coupled to a CMP controller 404, which is coupled to a belt steering control 406, an end point detection system 802, and a display 804.

In use, the sensor array 322 detects the presence of the end point window 414 when the end point window is position above the sensor array 322 during a CMP process. As previously mentioned, the sensor array 322 determines both the longitudinal position and the transverse position of the end point window 414 by detecting the presence of light and by determining which sensors of the sensor array 322 detected the presence of light. The sensor data is then transmitted to the CMP controller 404, which analyzes the sensor data to determine the position of the end point window 414 and the speed of the polishing belt 304. The longitudinal position of the end point window 414 is used to calculate the proper time to trigger end point data acquisition by the end point detection system 802. The transverse position of the end point window 414 is used to determine the amount of positional correction necessary to properly align the end point window with the platen window. This information is provided to the belt steering control 406. In addition, the end point window positional information and belt speed are displayed to the user using the display 804.

Advantageously, the embodiments of the present invention logically correlate signals from multiple detector elements in an array so as to provide corroborative synchronization and steering information from multiple sensing points. This ability greatly enhances the robustness and reliability of belt steering and end point detection during the CMP process. In addition, by combining two separate functions into a single sensing apparatus, the embodiments of the present invention greatly simplify system set up and improve reliability. Moreover, by using multiple sensors in a wet environment, the embodiments of the present invention reduce the number of errors often encountered in prior art systems, which use single sensors designed for a dry environment.

Figure 9A:
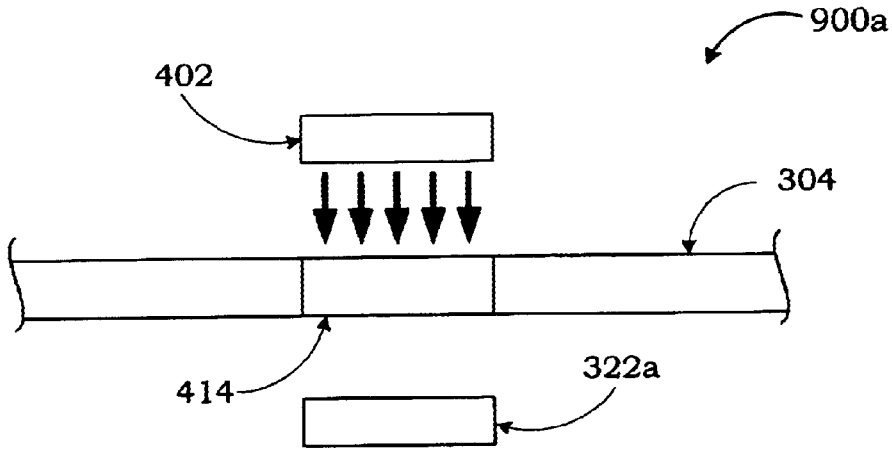
FIG. 9A is a diagram showing a charged coupled device (CCD) based end point trigger system, in accordance with an embodiment of the present invention.

As previously mentioned, the actual sensor array used by the embodiments of the present invention can configured in many different ways. For example, FIG. 9A is a diagram showing a charged coupled device (CCD) based end point trigger system 900*a*, in accordance with an embodiment of the present invention. The end point trigger system 900*a* includes a light source 402 disposed over a polishing belt 304 having an end point window 414. Positioned beneath the light source is a sensor array that comprises a CCD 322*a*.

Essentially, a CCD is an electronic memory that can be charged by light. CCDs can hold a variable charge, which is why they are used in cameras and scanners to record variable shades of light. Typically, CCDs are analog and generally are made of a special type of MOS transistor. Analog to digital (ADC) converters can be used to quantify the variable charge into a discrete number of values. Thus, by analyzing the states of the transistors that comprise the CCD 322*a*, the transverse and longitudinal positions of the end point window 414 can be determined.

Figure 9B:
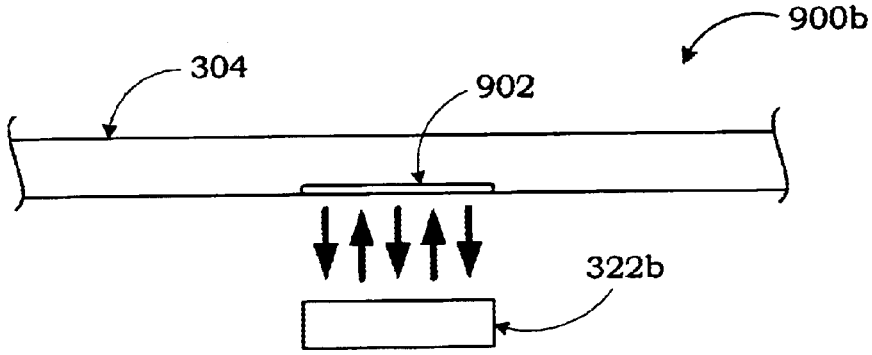
FIG. 9B is a diagram showing a reflection based end point trigger system, in accordance with an embodiment of the present invention.

FIG. 9B is a diagram showing a reflection based end point trigger system 900*b*, in accordance with an embodiment of the present invention. The end point trigger system 900*b* includes a reflective material 902 disposed beneath the polishing belt 304, and a sensor array 322*b* that detects light reflected off the reflective material 902. In the embodiment illustrated in FIG. 9B, the sensor array 322*b* can be positioned to a side of the polishing belt 304 as is the reflective material 902 in a manner similar to the configuration of a trigger slot in the polishing belt 304. In this manner, the end point window does not interfere with the end point trigger system 900*b*.

When the reflective material passes above the sensor array 322*b*, light is reflected back at the sensor array at a high intensity, which is detected by the sensors of the sensor array 322*b*. The number of sensors and position of the sensors that detect the reflected light determine the end point window position, as described previously. In addition, the length of time in which the reflected light is detected can be used to determine the speed of the polishing belt 304.

Figure 9C:
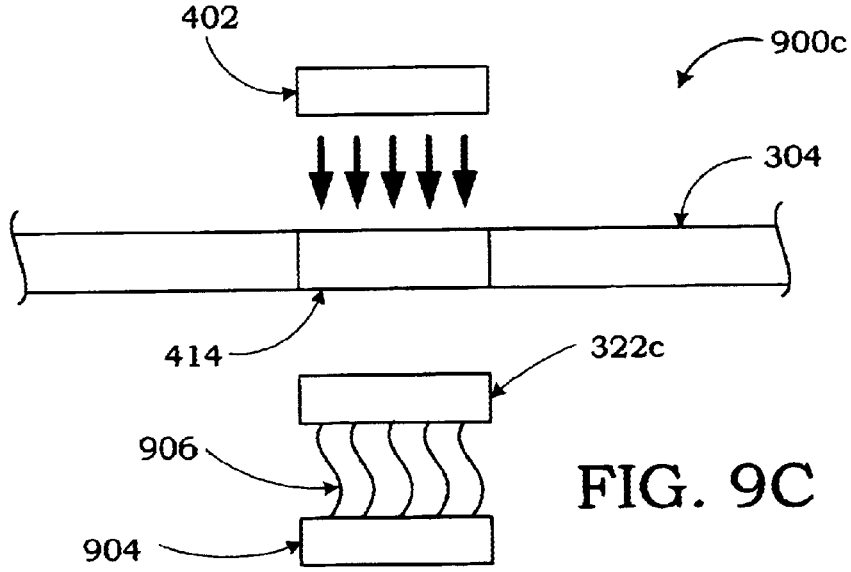
FIG. 9C is a diagram showing a Fiber Optic based end point trigger system, in accordance with an embodiment of the present invention.

FIG. 9C is a diagram showing a Fiber Optic based end point trigger system 900*c*, in accordance with an embodiment of the present invention. The end point trigger system 900*c* includes a light source 402 disposed above a polishing belt 304 having an end point window 414. Below the polishing belt 304 is a sensor array 322*c* comprising a plurality of fiber optic bundles 906 that are coupled to an optoelectric array sensor 904, which can be positioned a distance from the CMP system.

In operation, the fiber optic bundles 906 that are directly beneath the end point window are illuminated by the light source 402 and can provide a trigger signal to the end point detection system. Fiber optic bundles 906 outside the end point window are not illuminated and thus, the transverse end point window position can be determined by analysis of the active and non-active sensor pixels of the optoelectric array sensor 904.

Figure 9D:
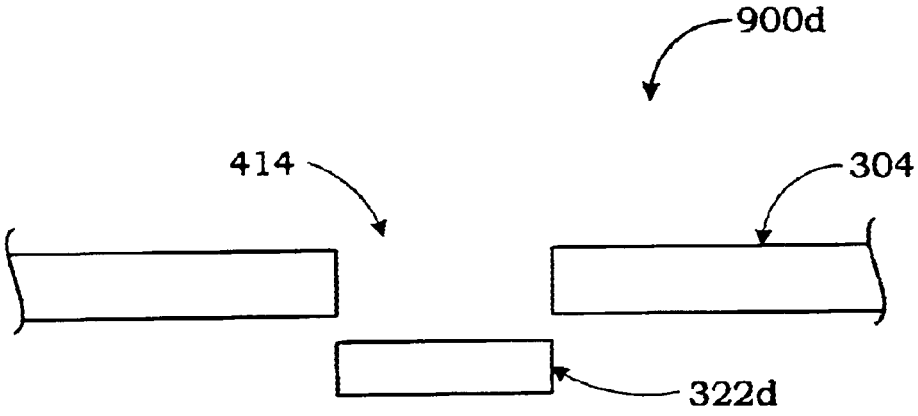
FIG. 9D is a diagram showing a proximity based end point trigger system, in accordance with an embodiment of the present invention.

FIG. 9D is a diagram showing proximity based end point trigger system 900*d*, in accordance with an embodiment of the present invention. The end point trigger system 900*d* includes an array of proximity sensors 322*d* positioned below the polishing belt 304, which includes an end point window 414. Other embodiments of the present invention can use ultrasonic sensors in place of the proximity sensors. In operation, the array of proximity sensors 322*d* can detect the present of the polishing belt 304. When the end point window 414 is positioned above the array of proximity sensors 322*d* the sensors detecting the presence of the polishing belt combined with the sensors that do not detect the presence of the polishing belt, because of being below the end point window, determine the positional information of the end point window.

Figure 9E:
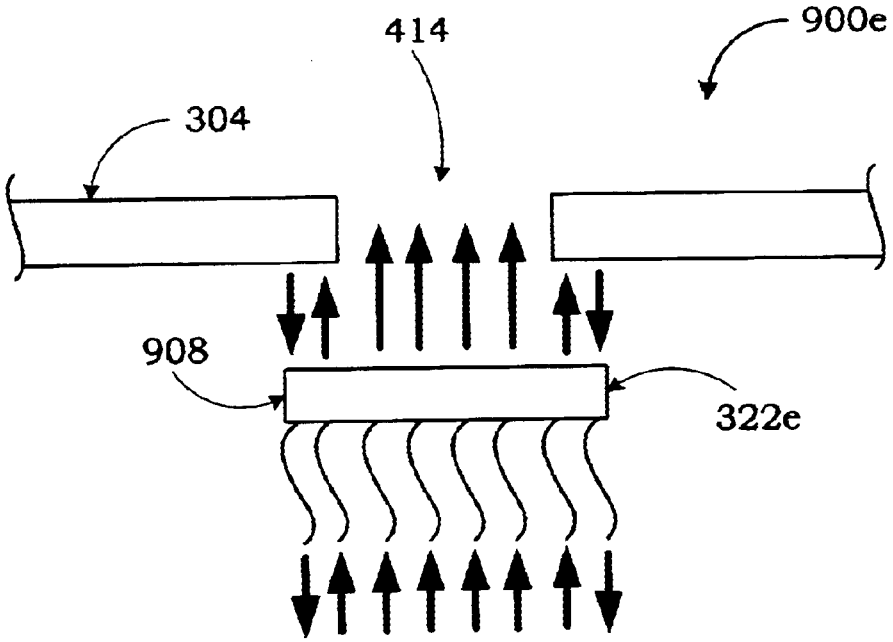
FIG. 9E is a diagram showing a bifurcated fiber optic based end point trigger system, in accordance with an embodiment of the present invention.

FIG. 9E is a diagram showing a bifurcated fiber optic based end point trigger system 900*e*, in accordance with an embodiment of the present invention. The end point trigger system 900*e* includes a bifurcated fiber optic array 322*e* with spatial resolution disposed beneath a polishing belt 304 having an end point window 414. The bifurcated fiber optic array 322*e* both sends and receives light using fiber optic bundles 908. The bifurcated fiber optic array 322*e* also has spatial resolution, which provides positional information on the end point window 414.

Figure 10:
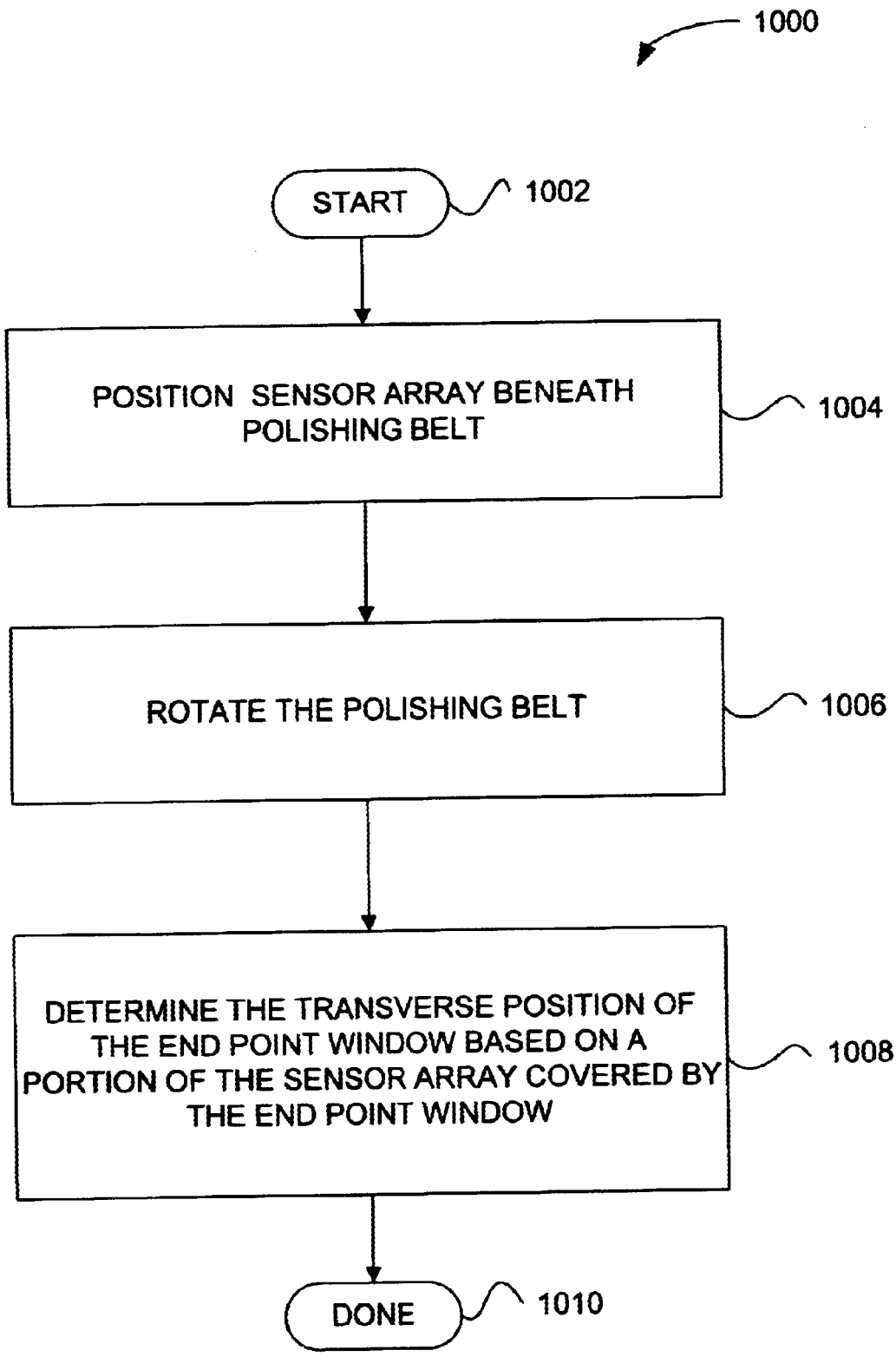
FIG. 10 is a flowchart showing a method for end point triggering in a CMP process, in accordance with an embodiment of the present invention.

FIG. 10 is a flowchart showing a method 1000 for end point triggering in a CMP process, in accordance with an embodiment of the present invention. In an initial operation 1002, preprocess operations are performed. Preprocess operations include fixing a wafer in place using a retaining ring, applying slurry to the polishing belt surface, and other preprocess operations that will be apparent to those skilled in the art.

In operation 1004, a sensor array is positioned beneath the polishing belt. The sensor array can be positioned so as to allow the end point window to pass directly over the sensor array during a CMP process. Further, the edges of the sensor can be large than the width of the end point window, such that specific sensors are not illuminated when the end point window is properly aligned with the platen window. In this case, the end point window can be determined to be unaligned if any of the specific sensors become illuminated. Alternatively, the sensor array can be positioned to the side of the polishing belt such that the end point window does not pass directly over the sensor array. In this embodiment, a trigger slot can be used to determine the position of the end point window.

The polishing belt is then rotated in operation 1006. Once the sensor array is properly positioned, the CMP process is started. The polishing belt is rotated at a predetermined speed, which can be detected and corrected using the sensor array and belt steering control, as previously described. Generally, as the polishing belt is rotated, the sensor array detects the presence of the end point window and uses that information to trigger end point data acquisition as described above.

In operation 1008, the transverse position of the end point window is determined based on a portion of the sensor array covered by the end point window. Generally, the sensor array is initially configured such that some sensors of the sensor array are non-illuminated because they are blocked from the light source by the polishing belt, and other sensors are illuminated by the light source through the end point window when the end point window is properly align with the platen window. Then, if any of the non-illuminated sensors become illuminated, the polishing belt would need to be moved in a direction opposite of the newly illuminated sensors. In this manner, the transverse position of the end point window can be determined and corrected using the plurality of sensors of the sensor array.

In addition, the longitudinal position and speed of the polishing belt can be determined using the leading and trailing edges of the polishing belt. Specifically, the leading edge of the end point window can be used to determine the longitudinal position of the polishing belt. To this end, when the sensors are illuminated by the light source, the end point window is positioned above the sensor array. Further, the speed of the polishing belt can be determined by the time interval between the leading edge of the end point window passing over the sensors and the trailing edge of the end point window passing over the sensors. Thus, the duration of illumination of the sensors of the sensor array can be used to calculate the speed of the polishing belt since the distance between the leading edge and the trailing edge of the end point window is known. It should be noted that a trigger slot can also be used for the end point trigger mechanism. In this case the sensor array would be aligned with the trigger slot and the belt positional information would be determined based on light detected though the trigger slot.

Post process operations are performed in operation 1010. Post process operations include end point data acquisition, belt steering, and other post process operations that will be apparent to those skilled in the art. Advantageously, the embodiments of the present invention logically correlate signals from multiple detector elements in an array so as to provide corroborative synchronization and steering information from multiple sensing points. This ability greatly enhances the robustness and reliability of belt steering and end point detection during the CMP process.

In addition, by combining two separate functions into a single sensing apparatus, the embodiments of the present invention greatly simplify system set up and improve reliability. Moreover, by using multiple sensors in a wet environment, the embodiments of the present invention reduce the number of errors often encountered in prior art systems, which use single sensors designed for a dry environment.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for end point triggering in a chemical mechanical polishing process, the method comprising the operations of:

positioning a sensor array beneath a polishing belt, the polishing belt having an end point window;

rotating the polishing belt; and determining a transverse position of the end point window based on a portion of the sensor array covered by a particular portion of the polishing belt.

2. A method as recited in claim 1, wherein the particular portion of the polishing belt is the end point window.

3. A method as recited in claim 1, wherein the particular portion of the polishing belt is a trigger slot.

4. A method as recited in claim 1, wherein the particular portion of the polishing belt is covered by a reflective material.

5. A method as recited in claim 1, wherein the sensor array is a charged coupled device (CCD).

6. A method as recited in claim 1, wherein the sensor array is a linear array of sensors.

7. A method as recited in claim 6, further comprising the operation of determining which sensors are covered by the particular portion of the polishing belt.

8. A method as recited in claim 7, further comprising the operation of communicating the transverse position of the end point window to a belt steering system.

9. A method as recited in claim 8, wherein the belt steering system corrects the transverse position of the end point window based on which sensors are covered by the particular portion of the polishing belt.

10. A method as recited in claim 1, further comprising the operation of determining a time to begin end point detection based on a longitudinal position of the end point window.

11. A method as recited in claim 1, further comprising the operation of determining a speed of the belt based on light intensities sensed by the sensor array.

12. An apparatus for end point triggering in a chemical mechanical polishing process, comprising:

a sensor array disposed beneath a polishing belt, wherein the polishing belt includes an end point window, wherein a position of the end point window is determined based on a portion of the sensor array covered by a particular portion of the polishing belt.

13. An apparatus as recited in claim 12, wherein the particular portion of the polishing belt is the end point window.

14. An apparatus as recited in claim 13, wherein the sensor array is a linear array of sensors.

15. An apparatus as recited in claim 14, wherein the position of the end point window is determined based on which sensors are covered by the end point window.

16. An apparatus as recited in claim 15, wherein the position of the end point window is communicated to a belt steering system.

17. An apparatus as recited in claim 16, wherein the belt steering system corrects the position of the end point window based on which sensors are covered by the end point window.

18. An apparatus as recited in claim 12, wherein a time to begin end point detection is determined based on the position of the end point window.

19. An apparatus as recited in claim 12, wherein a speed of the belt is determined based on intensities sensed by the sensor array.

20. A system for end point triggering in a chemical mechanical polishing process, comprising:

a polishing belt having an end point window;

a sensor array disposed beneath the polishing belt, wherein a position of the end point window is determined based on a portion of the sensor array covered by a particular portion of the polishing belt; and a belt steering system, wherein the belt steering system corrects a belt position based on the position of the end point window.

21. A system as recited in claim 20, wherein the particular portion of the polishing belt is the end point window.

22. A system as recited in claim 21, wherein the sensor array is a linear array of sensors.

23. A system as recited in claim 22, wherein the position of the end point window is determined based on which sensors are covered by the end point window.

24. A system as recited in claim 20, wherein a time to begin end point detection is determined based on the position of the end point window.

25. A system as recited in claim 20, wherein a speed of the belt is determined based on intensities sensed by the sensor array.

* * * * *